United States Patent [19]

Thevis et al.

[11] Patent Number: 4,512,236

[45] Date of Patent: Apr. 23, 1985

[54] SOUND DAMPENED AUTOMATIC HAND FIREARM

[75] Inventors: Paul Thevis, Oberndorf; Helmut Danner, Sulz-Sigmarswangen, both of Fed. Rep. of Germany

[73] Assignee: Heckler & Koch GmbH, Oberndorf, Fed. Rep. of Germany

[21] Appl. No.: 405,596

[22] Filed: Aug. 5, 1982

[30] Foreign Application Priority Data

Aug. 7, 1981 [DE] Fed. Rep. of Germany ..... 3131264

[51] Int. Cl.[3] ..... F41D 11/06

[52] U.S. Cl. ..... 89/128; 89/153

[58] Field of Search ..... 42/69 A, 69 B, 10, 11; 89/128, 132, 153, 161, 69–70

[56] References Cited

U.S. PATENT DOCUMENTS 661,900 11/1900 Von Zeke et al. ..... 89/153
839,911 1/1907 Wesson ..... 42/11

FOREIGN PATENT DOCUMENTS 1095166 12/1960 Fed. Rep. of Germany .
1428772 1/1970 Fed. Rep. of Germany .
2384224 10/1978 France .
309376 3/1969 Sweden ..... 42/69 B

OTHER PUBLICATIONS

Journal "Wehrtechnik", No. 11, 1977, pp. 13 and 17, (in German) especially p. 17, middle column, lines 9–14, (by Rolf Tophoven).

*Primary Examiner*—Stephen C. Bentley
*Attorney, Agent, or Firm*—Burmeister, York, Palmatier, Hamby & Jones

[57] ABSTRACT

The invention relates to a sound dampened automatic hand firearm provided with silencing means for the firing of projectiles at a muzzle velocity in the subsonic speed range. In order to reduce also the breechblock noise during shot release, in addition to the muzzle noise and the projectile boom, a locking lever (18) is provided for locking the closed breechblock during discharge of the weapon. Preferably, the locking lever (18) is pivotable about an axis (19) oriented transversely to the barrel axis (24) and is held out of engagement by a spring (20). Associated with the trigger system is a catch (15) which causes the locking lever (18) to be pivoted into the locking position as the trigger (6) is being pulled. The catch (15) is pivotably mounted on the trigger (6).

11 Claims, 4 Drawing Figures

SOUND DAMPENED AUTOMATIC HAND FIREARM

FIELD OF THE INVENTION

This invention relates to a sound dampened automatic hand firearm provided with silencing means for the firing of projectiles at a muzzle velocity in the subsonic speed range.

BACKGROUND OF THE INVENTION

A known weapon of this type (automatic pistol MP 5 SD) is provided with a silencer capable of reducing the noise of the muzzle blast to a level such that the weapon is superbly suitable for commandos and special missions. Contributing to this quiet operation is the feature that the projectiles, although in the form of conventional ammunition, leave the barrel at subsonic speed so as to avoid the boom that inevitably accompanies the firing of projectiles at supersonic speeds. The reduction in muzzle velocity of the projectiles is achieved by providing the barrel with transverse grooves which terminate in an expansion space sealed off to the outside, whereby the gas pressure is decreased by an amount such that the bullet speed at the muzzle is slightly less than Mach 1. Moreover, this well known weapon has the additional advantage that the breechblock is closed before discharge of the weapon so that there is no sound whatever occurring immediately prior to firing. However, in an automatic weapon, which automatically discards an empty cartridge and feeds the next cartridge from the magazine, it is unavoidable that metallic noises are generated by the relatively rapid breechblock action. Now, there are instances when even this not very loud noise must be avoided because it betrays the presence and the location of the shooter.

SUMMARY OF THE INVENTION

It is therefore the object of the present invention to so design an automatic hand firearm of the aforesaid type that also the breechblock sound is avoided or suppressed.

This is accomplished according to the invention in that a hand firearm of the foregoing type is provided with a locking lever capable of locking the closed breechblock during the discharge of the weapon. By virtue of this simple device realized at very little expenditure, the breechblock noise is completely eliminated. As somewhat of a trade-off, however, this improvement prevents the weapon from being self-loading. Instead, subsequent loading must be done by hand, but this can be accomplished nearly noiselessly with proper handling. The locking lever, of course, is so constructed that it may be optionally rendered operative or inoperative to enable the weapon, upon relinquishing the suppression of the breechblock noise, to be used as an automatic weapon for single shot, fire burst and continuous fire. As may be required in a given situation, the locking lever can be brought into its operative position by manually moving a locking pin into engagement with the lever to achieve the desired noise suppression for special purposes.

In a preferred embodiment of the invention, the locking lever is disposed in the longitudinal direction of the weapon and, by means of a spring, is held out of engagement in a position swingable about an axis transversely to the barrel axis. By applying excess pressure to this spring, the locking lever is caused to be moved into its operative position in which it is effective to lock the breechblock during and immediately after the firing for as long as recoil action and gas pressure are lasting.

While the locking lever can be actuated manually, there is always a possibility that, due to the excitement in the decisive phase of an action, it will be forgotten to push the locking lever into position against the force of the spring. Although this may be counteracted by the ability of the locking lever to be locked in its set position, the fact that then for unlocking of the lever another separate manipulation is required, speaks against it. Therefore, in a particularly preferred embodiment of the invention, a catch is connected with the trigger system by which the locking lever is moved into the locking position as the trigger is being pulled. Upon release of the trigger after the firing of a shot, the locking lever swings automatically back, under the action of the spring, and releases the breechblock so that the weapon again can be loaded and made ready for firing by the operator. In this manner, the safety factor against malfunctioning and improper handling of the weapon is enhanced because the shooter can concentrate completely on his mission, and the weapon is handled not any differently from other similar weapons. This is of particular significance in the execution of special missions and commandos in which the participants tend to be under a high degree of stress anyway.

The catch may be disposed in any structurally convenient place within the trigger system as, for example, on the sear or the like. Preferably, the catch is pivotably mounted on the trigger itself. As the trigger is being pulled, the catch is caused to engage the locking lever and swing it into the locking position which is reached shortly before the shot breaks. When the shooter then lets go of the trigger, the breechblock again is automatically unlocked.

It is, ouf course, possible to achieve the same effect of suppressing the breechblock noise without introducing any additional mechanism, simply by using a repeating weapon. However, the use of repeating firearms is generally ruled out for the reason that during an action of this type, the scenario is frequently such that the need for increased sound dampening by way of suppressing the noise is obviated because the presence of the shooter has already been discovered anyway, a situation then calling for a high degree of firepower which can be achieved only with an automatic hand firearm. Such automatic hand firearms are commonly equipped with a safety shaft for selecting the various particular firing modes, such as single shot, continuous fire, fire burst or Secured. In the latter mode setting the weapon cannot be fired. Discharging the weapon with the breechblock noise silenced by means of locking the breechblock is, of course, possible only in the single shot mode, and not in the fire burst or continuous fire modes. In all firing modes, however, the firing is effected by the trigger.

Thus, in a preferred embodiment of the invention, the catch projects with one end into the range of the safety shaft. The safety shaft is provided with a projection or stop by means of which the catch is disengaged from the locking lever in the firing modes of continuous fire and fire burst. In this manner it is insured that the weapon, when reset to the continuous firing mode or fire burst mode, will automatically regain its function as an automatic firearm without requiring the shooter to perform any additional manipulation. To this end, the safety shaft may be designed to include two firing mode positions for single shot, whereby in one of these two positions the catch may be disengaged from the locking lever. Thus, the weapon is so constructed as to permit two different firing modes for single shot fire, namely, one in which the breechblock is locked, and one in which the breechblock is not locked. In the firing mode without breechblock locking, the weapon is usable as a conventional automatic hand firearm, while it is only in the firing mode with breechblock locking that the greater noise damping is achieved by suppressing the breechblock noise.

The engagement of the locking lever into the path of movement of the breechblock may be accomplished in different ways. In a preferred embodiment of the invention, the breechblock is provided with a recess to be engaged by the locking lever in the locking position, with the locking leaver bearing against a surface disposed transversely to the path of movement of the breechblock. Preferably, this surface is approximately tangential to the axis of the locking lever.

It is essential to the suppression of the breechblock noise that the locking of the breechblock is effected without play. This can be accomplished, for example, by interposing resilient buffer means between the breechblock and locking lever, with the buffer being preloaded in the engaged position. However, such buffer means tend to interfere with the engagement and disengagement of the locking lever and thus cause malfunctioning. Therefore, in a preferred embodiment of the invention, the engaging surface forms an acute wedge or cutting angle with the surface of the recess in the breechblock, the origin pointing in a direction opposite to the direction of movement of the engaging surface into the locking position. This ensures a playfree engagement and locking of the breechblock. In yet another embodiment of the invention, a spring element is provided in the path of the transmission of force from the trigger to the engaging surface of the locking lever. Otherwise, the mechanism would require an excessively high degree of manufacturing precision because only then would it be possible to realize the desired freedom from play. However, a spring element introduced into the transmission of force will compensate for minor inaccuracies and tolerances and still ensure the playfree locking of the breechblock. The spring element may be disposed between the catch and locking lever, for example. The catch engages an intermediate lever adjacent the locking lever. The intermediate lever braces itself against the locking lever by way of a spring. Or, the catch itself may take the form of a leaf spring capable of being resiliently deflected.

BRIEF DESCRIPTION OF THE DRAWINGS

These and other objects and advantages of the present invention will be fully apparent from the following description of an illustrative embodiment shown in the drawings, and further in connection with the claims. The drawings are simplified and schematic representations, omitting details not required for an understanding of the present invention, in which:

DETAILED DESCRIPTION OF AN ILLUSTRATIVE EMBODIMENT

Figure 1:
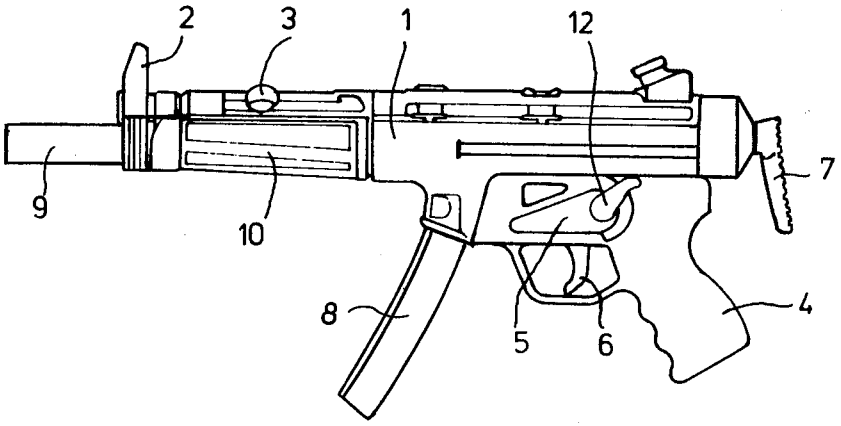
FIG. 1 is a side view of a sound dampened automatic hand firearm.

The weapon illustrated in FIG. 1 comprises a casing 1, a barrel covered by a hand guard 10, a sight 2, and a loading lever 3 permitting the manual loading of the weapon. The weapon further is provided with a pistol grip 4 having attached thereto a trigger case 5 with a trigger 6. There is also provided a telescopic shoulder piece 7. The ammunition is contained in a magazine 8. Mounted on the muzzle of the pistol is a silencer 9.

Figure 2:
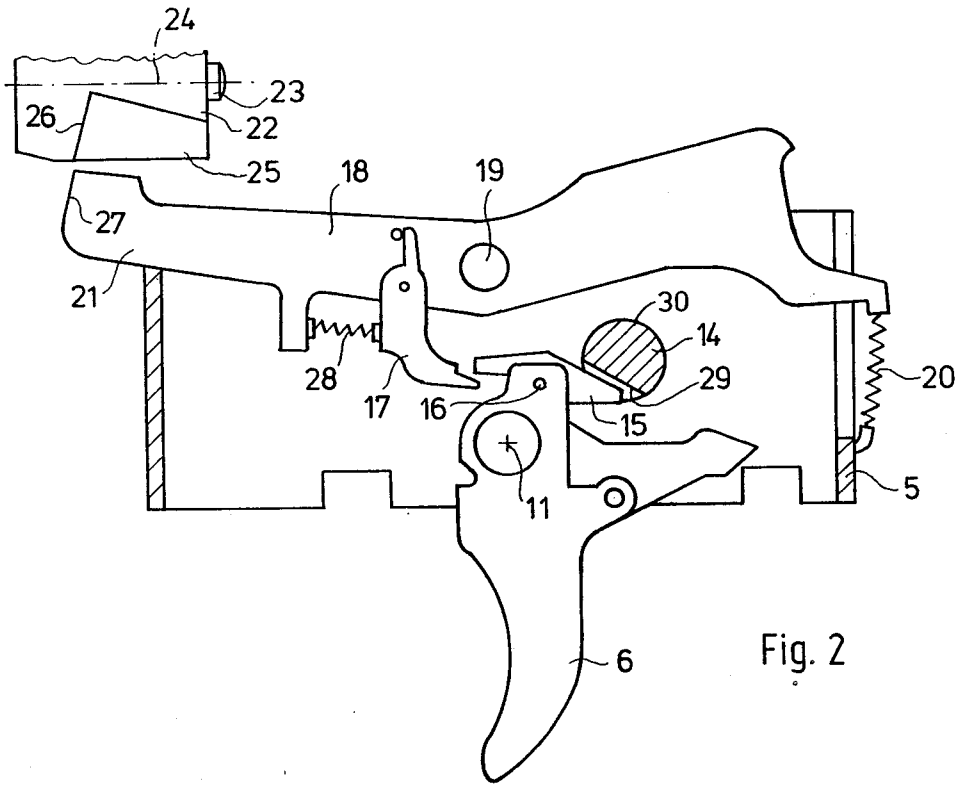
FIGS. 2 to 4 are side views of the trigger system, with the trigger case being shown open, and further showing different positions of the safety shaft and the trigger.
Figure 3:
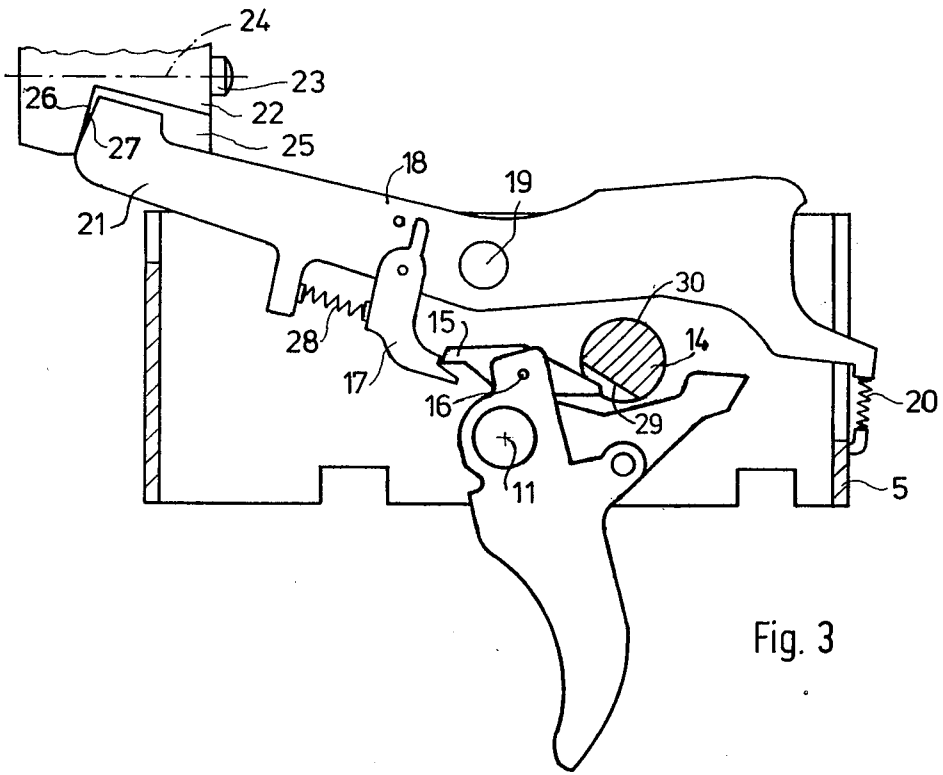
Figure 4:
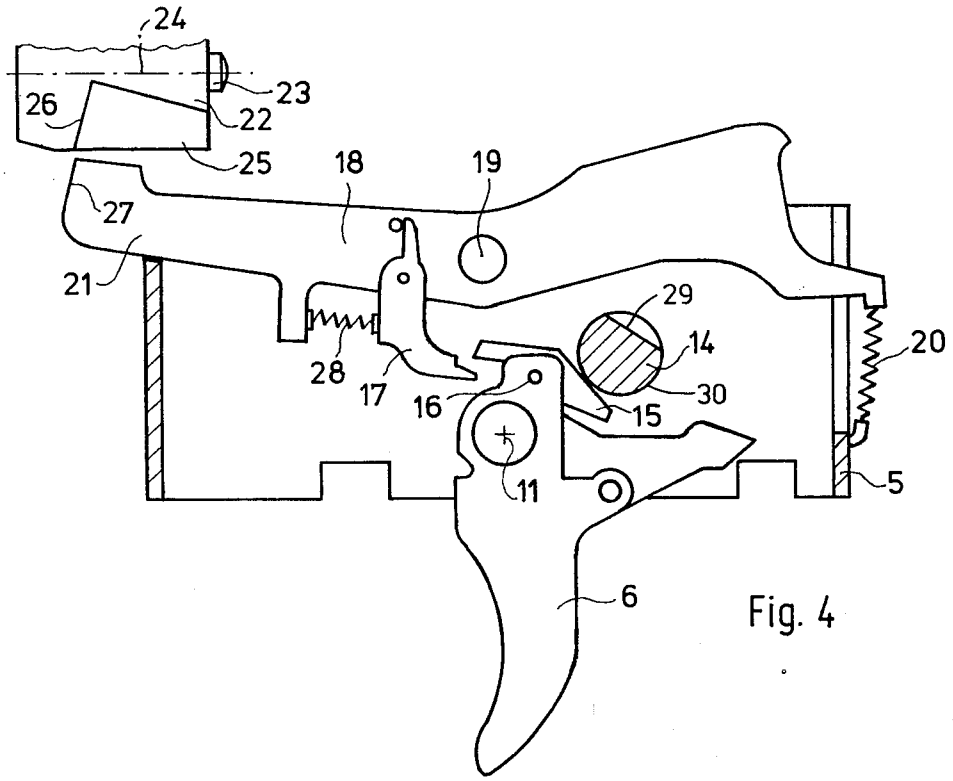

FIGS. 2 to 4 are side views of the open trigger case 5; some components such as the catch pawl, shot counter, and the like, have been omitted since they are the same as in the known conventional weapon and their being shown is not necessary for an understanding of the present invention.

The trigger 6 is pivotably mounted about an axis 11 in the trigger case 5. Disposed parallel to the axis 11 in the trigger case 5 is a rotatable safety shaft or bolt 14 adapted to be rotated into its various positions by means of a safety lever 12 located outside the trigger case 5. FIGS. 2 and 3 show the position of the shaft 14 characteristic for the firing mode "single shot with locked breechblock", whereas FIG. 4 illustrates a position in which the breechblock has not been locked.

Mounted on the trigger 6 is a catch 15, pivotable about an axis 16, which is biased in the counterclockwise direction by a spring, not illustrated. Pulling the trigger 6 (in counterclockwise direction about the axis 11) causes the catch 15, when the safety shaft 14 is in the position shown in FIGS. 2 and 3, to move from the position according to FIG. 2 into the position according to FIG. 3, bearing against an arm 17 provided on the locking lever 18 extending in the longitudinal direction of the weapon. The locking lever 18 is pivotably mounted in the trigger case 5 about an axis 19 disposed transversely to the barrel axis so as to be capable of being moved into a position behind the breechblock 22 and thereby lock the breechblock. The locking lever 18 is in the shape of a two-arm structure. In the region of its rearward end, the lever 18 is engaged by a compression spring 20 braced against the trigger case 5. The locking lever 18 is biased in counterclockwise direction by the compression spring 20 so as to swing its opposite end 21 out of the path of movement of the breechblock 22 in which the firing pin 23 is located. The breechblock 22, which in known manner is movable along an axis 24 coaxial with the barrel, is provided with a recess 25. The recess 25 includes an abutment surface 26 oriented approximately transversely to the axis 24, for engagement by the surface 27 provided on the forward end 21 of the locking lever 18. The surface 27 of the locking lever 18 makes a small acute angle with the abutment surface 26, with the origin of the angle pointing away from the axis 24. The surface 27 may also be curved and may, for instance, take the form of a cylindrical surface area, the center axis of which being slightly displaced in the downward direction with respect to the axis 19 of the locking lever 18 and toward the trigger 6. The surface 27 may also be a plane surface. By virtue of the wedge angle formed between the two surface areas 26 and 27, an engagement without play and, thus, a playfree locking of the breechblock 22 is accomplished.

In order to reliably compensate for tolerances and possible wear on the surfaces 26 and 27, for example, and yet obtain a playfree engagement and locking action, a spring element is introduced into the transmission of force from a trigger 6 to surface 27. This resilient element may be realized, for example, by making the arm 17 of the locking lever 18 pivotable and by causing it to be biased in the direction toward the catch 15 by a compression spring 28 bearing against the locking lever 18. Due to this particular arrangement, the locking lever 18 is actuated not positively, but by spring action.

The safety shaft 14 has a recess 29 in which the catch 15 is received when the shaft 14 is adjusted to its position to provide for breechblock locking, as described above. To render the locking lever inoperative, the safety shaft 14 is provided with with a shoulder or surface 30 for all of its positions which correspond to firing modes without breechblock locking. The surface 30 causes the catch 15 to be moved in clockwise direction and thereby be disengaged from the arm 17. This condition is illustrated in FIG. 4. The spring 20 then keeps the forward end 21 of the locking lever 18 out of the path of movement of the breechblock 22.

The weapon described in the foregoing may be used in the same manner as the familiar sound-dampened automatic pistol, but it affords the user the additional opportunity for single shot firing in the non-automatic mode so that the breechblock noise likewise is completely suppressed while, optionally, the weapon can be converted to full firing capacity, like the familiar machine pistol, by a simple pivoting of the safety shaft.

We claim:

1. A sound dampened automatic hand firearm of the type provided with silencing means for the firing of projectiles at a muzzle velocity in the subsonic speed range, said firearm comprising a breechblock movable in a predetermined direction between closed and open positions, said breechblock having abutment means, a locking lever swingable into engagement with said abutment means for locking said breechblock in its closed position during the release of a shot to prevent opening movement of the breechblock by the shot, said locking lever being pivotable about an axis oriented transversely to the direction of movement of the breechblock, a spring biasing said locking lever toward an unlocking position in which said lever is out of the path of said abutment means to provide for the manual opening of said breechblock, a trigger swingable between an initial position and a pulled position for releasing a shot, and a catch connected to and pivotally mounted on said trigger and operable by swinging movement of said trigger toward said pulled position thereof for swinging said locking lever into a locking position with said locking lever engaging said abutment means and for maintaining said locking lever in said locking position as long as said trigger is in its pulled position, said catch being operative to swing said locking lever to its locking position against the biasing action of said spring, whereby said catch and said locking lever are operative to prevent movement of said breechblock away from its closed position by the release of a shot.

2. A firearm according to claim 1, including a safety shaft rotatable to a series of different firing mode positions including a single shot breechblock locking position and other firing mode positions, said safety shaft having a catch disabling member which is out of engagement with said catch in said breechblock locking position but is movable into engagement with said catch in the other positions of the shaft for moving and holding the catch out of engagement with said locking lever to prevent said catch from moving said locking lever into its locking position.

3. A firearm according to claim 2, in which said safety shaft is rotatable to a position for a single shot breechblock unlocking mode in which said catch disabling member engages said catch and holds it out of engagement with said locking lever to prevent movement of the locking lever by said catch.

4. A firearm according to claim 1, said abutment means including a recess in said breechblock for receiving said locking lever in its locking position, said abutment means also including an abutment surface on said breechblock and in said recess, said abutment surface being disposed transversely to the direction of motion of said breechblock, said abutment surface being approximately tangential to the pivotal axis of said locking lever.

5. A firearm according to claim 1, said breechblock including a recess for receiving said locking lever in its locking position, said abutment means including an abutment surface in said recess and on said breechblock, said abutment surface being disposed transversely to the direction of motion of said breechblock, said locking lever having an engagement surface for engaging said abutment surface, said engagement surface when engaging said abutment surface enclosing an acute angle therewith, said acute angle having its origin pointing in a direction opposite from the direction of movement of said engagement surface into locking engagement with said abutment surface.

6. A firearm according to claim 5, including a spring connection between said catch and said locking lever for resiliently urging said engagement surface of said lever into engagement with said abutment surface on said breechblock when said trigger is swung to said pulled position.

7. A firearm according to claim 1, including a spring connection between said catch and said locking lever for resiliently urging said locking lever into engagement with said abutment means when said trigger is swung to said pulled position.

8. A sound dampened automatic hand firearm of the type provided with silencing means for the firing of projectiles at a muzzle velocity in the subsonic speed range, said firearm comprising a breechblock movable in a predetermined direction between closed and open positions, said breechblock having abutment means, a locking lever swingable into engagement with said abutment means for locking said breechblock in its closed position during the release of a shot to prevent opening movement of the breechblock by the shot, said abutment means including an abutment surface on said breechblock, said locking lever having an engagement surface engageable with said abutment surface at a wedging angle to prevent play between said breechblock and said locking lever, said locking lever being pivotable about an axis oriented transversely to the direction of movement of the breechblock, a spring biasing said locking lever toward an unlocking position in which said lever is out of the path of said abutment means to provide for the manual opening of said breechblock, a trigger swingable between an initial position and a pulled position for releasing a shot, a catch connected to said trigger and operable by swinging movement of said trigger toward said pulled position thereof, and a spring connection between said catch and said locking lever for swinging said locking lever into a locking position with said engagement surface of said locking lever in wedging engagement with said abutment surface and for maintaining said locking lever in said locking position as long as said trigger is in its pulled position, said catch and said spring connection being operative to swing said locking lever to its locking position against the biasing action of said spring in response to swinging movement of said trigger toward its pulled position, whereby said catch along with said spring connection and said locking lever are operative to prevent movement of said breechblock away from its closed position by the release of a shot.

9. A firearm according to claim 8, said spring connection comprising an arm pivotally mounted on said locking lever and engageable by said catch, and an additional spring connected between said locking lever and said arm and biasing said arm toward said catch.

10. A sound dampened automatic hand firearm of the type provided with silencing means for the firing of projectiles at a muzzle velocity in the subsonic speed range, said firearm comprising a breechblock movable in a predetermined direction between closed and open positions, said breechblock having abutment means, a locking lever swingable into engagement with said abutment means for locking said breechblock in its closed position during the release of a shot to prevent opening movement of the breechblock by the shot, said abutment means including an abutment surface on said breechblock, said locking lever having an engagement surface engageable with said abutment surface at a wedging angle to prevent play between said breechblock and said locking lever, said locking lever being pivotable about an axis oriented transversely to the direction of movement of the breechblock, a spring biasing said locking lever toward an unlocking position in which said lever is out of the path of said abutment means to provide for the manual opening of said breechblock, a trigger swingable between an initial position and a pulled position for releasing a shot, a catch connected to said trigger and operable by swinging movement of said trigger toward said pulled position thereof, and a spring connection between said catch and said locking lever for swinging said locking lever into a locking position with said engagement surface of said locking lever in wedging engagement with said abutment surface and for maintaining said locking lever in said locking position as long as said trigger is in its pulled position, said catch and said spring connection being operative to swing said locking lever to its locking position against the biasing action of said spring in response to swinging movement of said trigger toward its pulled position, whereby said catch along with said spring connection and said locking lever are operative to prevent movement of said breechblock away from its closed position by the release of a shot, said firearm including a safety shaft rotatable to a series of firing mode positions including a single shot breechblock locking position and other firing mode positions, said safety shaft having a catch disabling member which is out of emgagement with said catch in said breechblock unlocking position but is movable into engagement with said catch in the other positions of the shaft for moving and holding the catch out of engagement with said spring connection to prevent said catch from moving said locking lever into its locking position.

11. A firearm according to claim 10, in which safety shaft is rotatable to a position for a single shot breechblock unlocking mode in which said catch disabling member engages said catch and holds it out of engagement with said spring connection to prevent movement of the locking lever by said catch.

* * * * *